US005853275A

United States Patent [19]

Lentz et al.

[11] Patent Number: 5,853,275

[45] Date of Patent: Dec. 29, 1998

[54] APPARATUS FOR FLANGING CAN BODIES

[75] Inventors: Norbert Lentz, Essen; Karl-Heinz Witt, Recklinghausen; Steffen Rötz, Essen, all of Germany

[73] Assignee: Krupp Kunststofftechnik Gesellschaft mit beschränkter Haftung, Essen, Germany

[21] Appl. No.: 889,496

[22] Filed: Jul. 8, 1997

[30] Foreign Application Priority Data

Jul. 18, 1996 [DE] Germany ..... 196 28 995.5

[51] Int. Cl.[6] ..... B21D 19/02

[52] U.S. Cl. ..... 413/73; 72/126; 72/379.4

[58] Field of Search ..... 413/73, 76, 69; 72/126, 379.4, 124, 118, 119, 115, 117

[56] References Cited

U.S. PATENT DOCUMENTS

| | | | |
|---|---|---|---|
| 3,494,162 | 2/1970 | Hansson | 413/69 X |
| 3,688,538 | 9/1972 | Hoyne | 413/69 X |
| 4,058,998 | 11/1977 | Franek et al. | 413/69 X |
| 4,070,888 | 1/1978 | Gombas | 72/91 |
| 4,176,536 | 12/1979 | Panknin et al. | 413/69 X |
| 4,723,430 | 2/1988 | Hahn | 413/73 X |
| 5,121,621 | 6/1992 | Ihly | 72/126 |
| 5,376,174 | 12/1994 | Sommer | 118/52 |

FOREIGN PATENT DOCUMENTS

| | | |
|---|---|---|
| 0 052 209 | 5/1982 | European Pat. Off. . |
| 2 042 954 | 3/1972 | Germany . |
| 195 01 002 | 10/1995 | Germany . |

*Primary Examiner*—James F. Coan
*Attorney, Agent, or Firm*—Spencer & Frank

[57] ABSTRACT

An apparatus for flanging an edge of a can body includes a flanging tool which has an inner tool part having an outer circumferential flanging face for engaging an inner surface of a circumferential edge zone of the can body; an outer tool part surrounding the inner tool part and having an inner circumferential abutment face surrounding the flanging face for abutting a periphery of the can body edge during flanging of the can body edge by the flanging face; an axially hollow, non-rotatable spindle to which the outer tool part is affixed and which has a first axis; a rotary shaft received in the spindle and having a second axis coinciding with the first axis; and a shaft stub affixed to and extending from the shaft. The inner tool part is rotatably mounted on the shaft stub which has a central, third axis disposed at an inclination to the second axis. The second and third axes intersect in a point situated substantially at an axial location corresponding to an axial location of the flanging face of the inner tool part.

5 Claims, 2 Drawing Sheets

APPARATUS FOR FLANGING CAN BODIES

CROSS REFERENCE TO RELATED APPLICATION

This application claims the priority of German Application No. 196 28 995.5 filed Jul. 18, 1996, which is incorporated herein by reference.

BACKGROUND OF THE INVENTION

This invention relates to an apparatus for flanging at least one edge of a can body, having at least one flanging tool formed of an inner tool part shaped to correspond to the flange contour and mounted on a rotary shaft and an outer tool part having an inner contour for the edge to be flanged. The apparatus further has a counter tool arranged coaxially with the flanging tool.

For flanging can body edges, upsetting flanging and spin flanging processes are used. In the upsetting flanging at least one non-rotating flanging tool (die or stamping member) is pressed against the can edge.

Spin flanging is described, for example, in U.S. Pat. No. 5,121,621. In the apparatus disclosed therein a receiving member secured to a rotary shaft is provided with a plurality of rollers which are shaped for performing the flanging operation and against which the can edge is moved. The flanging contour is determined by the external generatrices of the flanging rollers. The cylindrical inner face of a stationary housing borders the can edge to be flanged.

Further, German offenlegungsschrift (application published without examination) No. 195 01 002 discloses an apparatus for flanging and necking in which two one-piece flanging and/or necking tools corresponding to a conventional upsetting tool are rotatable on separate shafts and are axially shiftable along the respective shafts between a withdrawn, inoperative position and an operative position. The rotary and shifting axes of the flanging and/or necking tools are at an inclination to the axis of the can body to be flanged and/or necked. The apparatus for performing this conventional process requires a complex adjustment of the tools because their axes do not coincide with the axis of the can body and thus with the principal axis of the apparatus. Further, the can has to be rotatably supported while the deforming step is performed.

While an upsetting flanging operation involves the disadvantage that the deforming process does not proceed uniformly under certain circumstances, a spin flanging operation has the drawback that the great number of flanging rollers requires a complex drive assembly.

SUMMARY OF THE INVENTION

It is an object of the invention to provide an improved apparatus of the type disclosed in U.S. Pat. No. 5,121,621 with which a highly satisfactory can flange is obtained by means of a relatively simple structure.

This object and others to become apparent as the specification progresses, are accomplished by the invention, according to which, briefly stated, the apparatus for flanging an edge of a can body includes a flanging tool which has an inner tool part having an outer circumferential flanging face for engaging an inner surface of a circumferential edge zone of the can body; an outer tool part surrounding the inner tool part and having an inner circumferential abutment face surrounding the flanging face for abutting a periphery of the can body edge during flanging of the can body edge by the flanging face; an axially hollow, non-rotatable spindle to which the outer tool part is affixed and which has a first axis; a rotary shaft received in the spindle and having a second axis coinciding with the first axis; and a shaft stub affixed to and extending from the shaft. The inner tool part is rotatably mounted on the shaft stub which has a central, third axis disposed at an inclination to the second axis. The second and third axes intersect in a point situated substantially at an axial location (axial height) corresponding to an axial location (axial height) of the flanging face of the inner tool part. The inner and outer tool parts are prevented from rotation relative to one another. The apparatus has a counter tool axially aligned with the second axis and spaced from the flanging tool. The flanging tool and the counter tool jointly hold a can body and are urged toward one another for effecting flanging of the can body at the flanging face.

By supporting the inner tool part on the obliquely arranged shaft stub and by simultaneously preventing a rotation of the inner tool part about its axis, a tumbling motion for the inner tool part is obtained, by means of which points of the flanging surface contact in an orbiting motion the edge of the can body, and as feed is effected, it continuously flanges the can edge. By virtue of the arrangement of the inner face of the outer tool part coaxially with the axis, as early as upon the first contact of the flanging surface of the inner tool part with the can edge a bordering (abutting) function of the outer tool part is effected. By virtue of the intersection of the central axis of the stub shaft with the axis of the shaft, the flanging face of the inner tool part always remains central to the axis even during the tumbling motion.

DESCRIPTION OF THE PREFERRED EMBODIMENT

Figure 1:
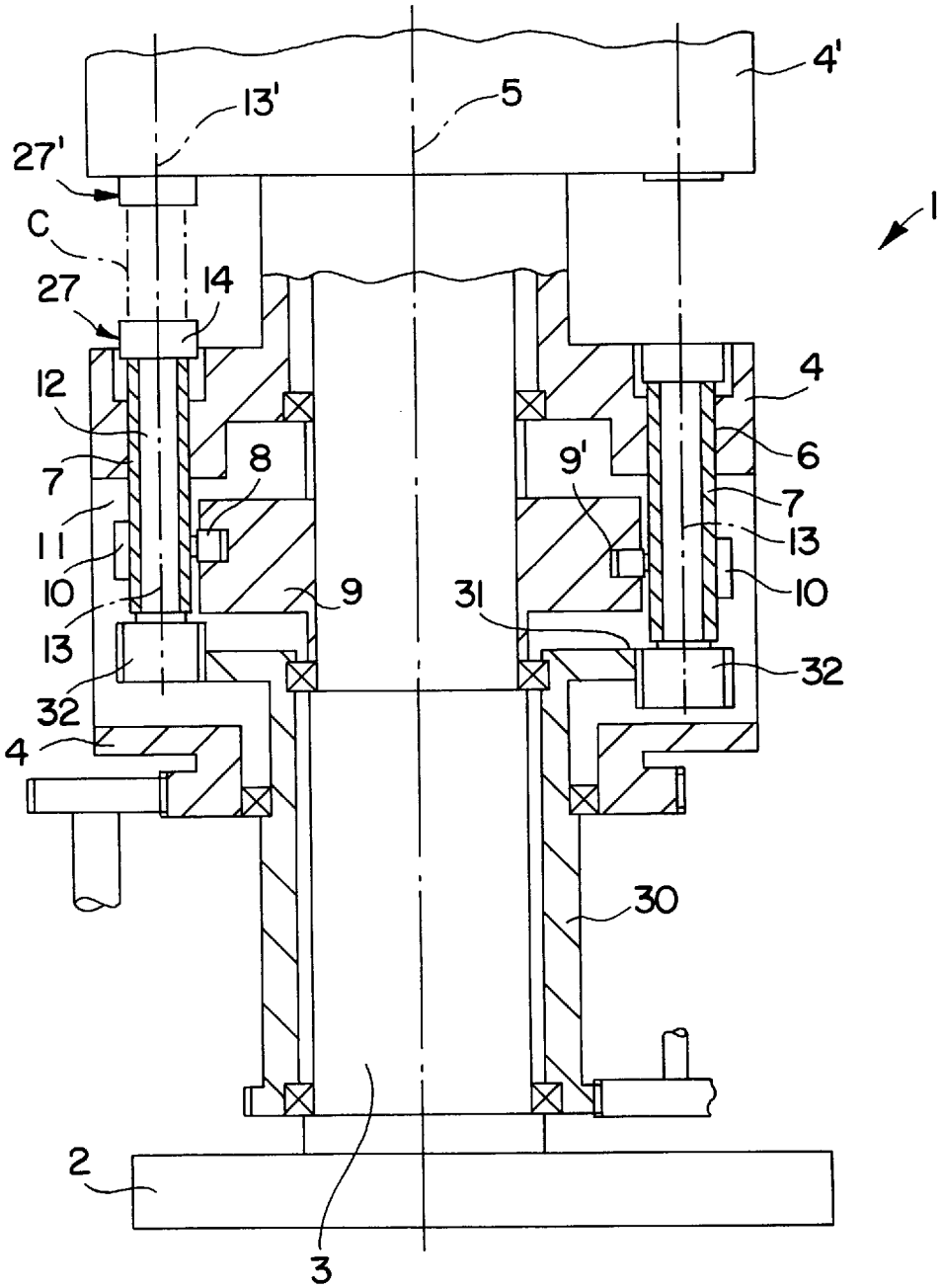
FIG. 1 is an axial sectional view of the apparatus according to a preferred embodiment.

Turning to FIG. 1, a machine generally designated at 1 for flanging cylindrical, open-ended can bodies C has a machine column 3 secured to a machine base 2 in a perpendicular orientation thereto. A turret 4 is mounted on the machine column 3 for rotary motion about the turret axis 5. The turret 4 has a plurality of circumferentially uniformly distributed spindle guide bores 6 in which axially hollow spindles 7 are supported for sliding motion relative to the turret 4 parallel to the axis 5. To each spindle 7 a follower roller 8 is mounted which extends into a circumferential camtrack 9' provided on the periphery of a cam 9 affixed to the column 3. Thus, as the turret 4 is rotated, the spindles 6 will execute their sliding motion relative to the turret 4 by virtue of the cooperation between the follower rollers 8 and the camtrack 9'.

A rotation of the spindle 7 about the respective spindle axis 13 within the spindle guide 6 is prevented by a spline or key 10 which is secured to the respective spindle 7 and which slides in a guide groove 11 provided in the associated spindle guide 6.

Figure 2:
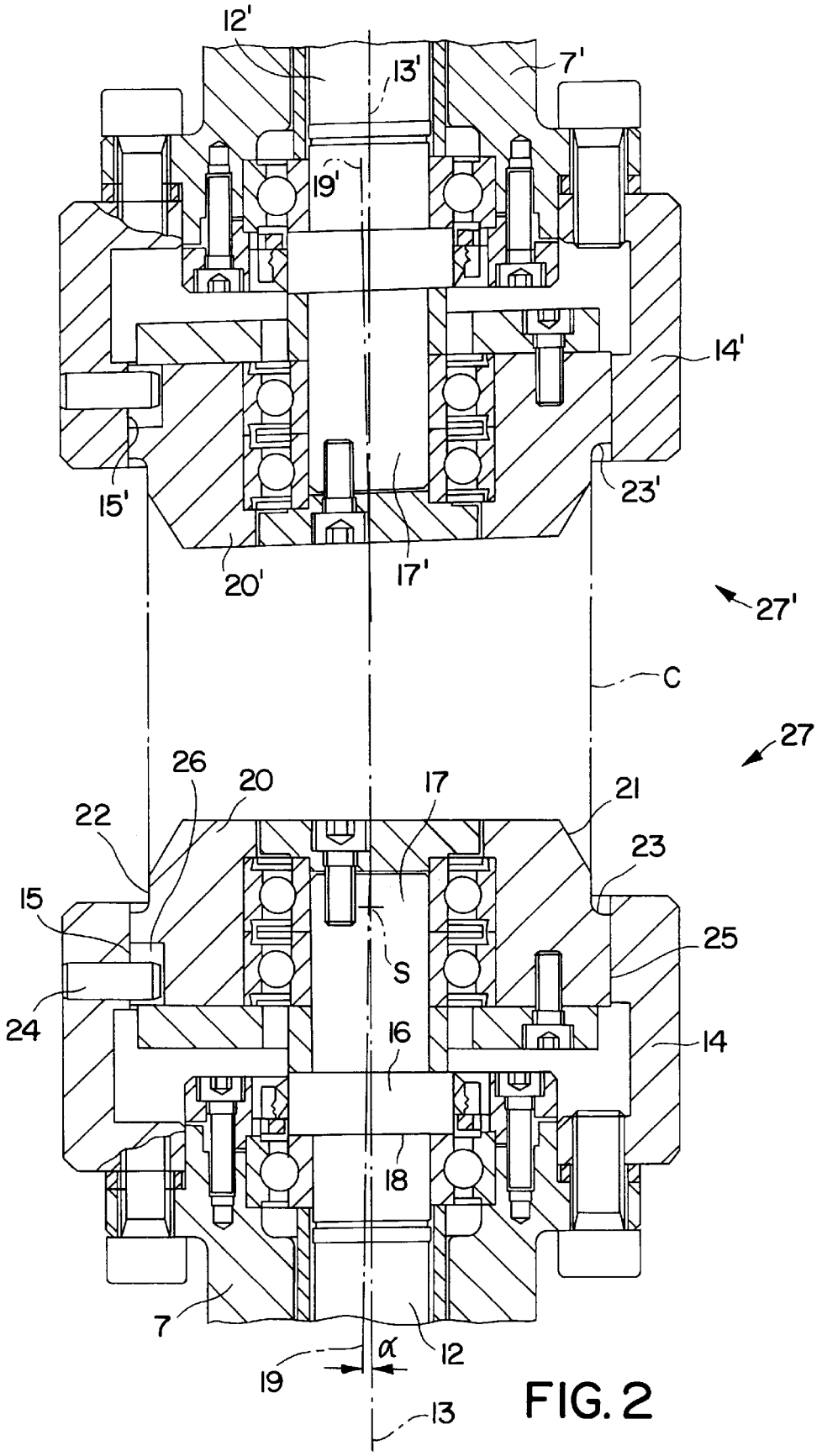
FIG. 2 is an enlarged axial sectional view of a detail of FIG. 1.

Reference is also made now to FIG. 2 which shows one of the plurality of assemblies mounted in a circular array on the turret 4. In the spindle 7 a shaft 12 is supported coaxially with the spindle axis 13 and is axially immovable relative to the spindle 7. At its upper end the spindle 7 carries a flanging sleeve 14 having an inner face 15. Each shaft 12 supported in the turret 4 is rotated by a drive sleeve 30 mounted for rotation on the column 3 and has a ring gear 31 which meshes with pinions 32, one being keyed to each shaft 12. The conventional mechanism for driving the turret 4 and the drive sleeve 30 is described in U.S. Pat. No. 5,376,174.

At the end of the shaft 12 a flange or collar 16 is arranged which is adjoined by a shaft stub 17 extending away from the shaft 12. The collar 16 has an outer surface which is cylindrical with respect to the axis 13 and has at its underside an abutment face 18 which is perpendicular to the axis 13.

The central axis 19 of the shaft stub 17 is inclined at an angle $\alpha$ to the axis 13 of the shaft 12. On the shaft stub 17 an inner flanging tool (inner tool part) 20 is rotatably supported which has, on its end oriented away from the shaft 12, a conical lead-in face 21, a guiding and holding face 22 and a flanging face 23. The flanging face 23 extends to the free circumference of the inner flanging tool 20 essentially perpendicularly to the central axis of the inner flanging tool.

The inner flanging tool 20 is rotatably but axially immovably supported on the shaft stub 17 by means of a bearing so that the central axis of the inner flanging tool 20 coincides with the axis 19 of the shaft stub 17.

In the operationally ready, installed state the inner flanging tool 20 is situated with a play radially inwardly of the inner face 15 of the flanging sleeve (outer tool part) 14. To prevent a relative rotation of the inner flanging tool 20 with respect to the flanging sleeve 14, a pin 24 is positioned in the flanging sleeve 14. The pin 24 extends into an axially parallel longitudinal groove 26 provided in the outer circumferential face 25 of the inner flanging tool 20.

When a lower open end of the can body C illustrated in dash-dot lines arrives in contact with the inner flanging tool 20 as a result of a relative axial motion therebetween, the lower can edge is first pushed over the lead-in or centering face 21 onto the guiding and holding face 22 where it is radially immobilized and, upon a further axial feed or the application of an axial force, is flanged outwardly by the flanging face 23. This deforming operation is discontinued when the periphery of the flanged edge of the can body C abuts against the inner face 15 of the flanging sleeve 14. Thus, the flanging sleeve 14 serves not only to receive the inner flanging tool 20 but also limits the flanging operation, and the inner face 15 simultaneously constitutes an abutment face (stop face) for the can edge under deformation. Thus, the entire flanging tool generally designated at 27 is essentially formed of the inner flanging tool 20 and the flanging sleeve 14 constituting the outer flanging tool. As illustrated in FIG. 1, the turret 4 carries a plurality of flanging tools 27 in a circular array.

As the turret 4 rotates, the spindles 7, as well as the flanging sleeves 14 do not rotate relative to the turret 4. Upon passing a can supply station from which a can body C is received—which is at a location where the orbital path of the axis 13 and the orbital path of a feeding star meet—the respective spindle 7 is, by means of the control cam 9, moved upwardly in the direction of the introduced can body C and is pressed against the lower edge of the can body C such that the edge is flanged. During the entire rotary motion of the turret 4 the shafts 12 are rotated as described, for example, in U.S. Pat. No. 5,376,174 for a lid coating machine. During rotation of each shaft 12 about its own axis 13, the radial position of the axis 19 of the respective shaft stub 17 changes within one cycle of a revolution. Such position changes with respect to the drawing plane of FIG. 2, for example, from the left forwardly, towards the right, rearwardly, etc. This results for the inner flanging tool 20 in a corresponding tumbling motion likewise towards the left, forwardly, to the right, rearwardly, etc. To the same extent, the highest point of the flanging face 23 which contacts the edge of the can body C moves from the right rearwardly, to the left, forwardly, etc. The contact location of the flanging face 23 with the can body C to be flanged and thus the location of deformation at the edge of the non-rotating can body C thus wanders circularly about the axis 13 once per revolution of the shaft 12 without a co-rotation of the inner flanging tool 20. In this manner the inner flanging tool 20 "tumbles" about the point S in which the axes 13 and 19 of the shaft 12 and the shaft stub 17 intersect. The point of intersection S—related to the inner flanging tool 20—lies at the height (axial position) of the flanging face 23, that is, between an imaginary plane passing through the lower end of the holding face 22 and an imaginary plane passing through the lower region of the flanging face 23 which runs out to the circumference of inner flanging tool 20.

To ensure that during the tumbling motion the flanging tool 20 lies with the flanging face 23 with a possibly small clearance against the inner face (abutment face) 15 of the flanging sleeve 14, the outer circumferential face 25 of the inner flanging tool 20, starting from the flanging face 23, is of conical configuration, wherein the cone angle corresponds to one-half of the angle $\alpha$ formed by the axes 13 and 19. In the alternative, the circumferential face 25 may be spherical in which case the center of such sphere coincides with the point of intersection S.

The inner flanging tool 20 and the flanging sleeve 14 receiving the inner flanging tool 20 and having the circumferential abutment surface 15 form a complete flanging tool 27 for one end of the can body C.

For flanging only a single edge of the can body of a so-called two-part can, each flanging tool 27 has a counter tool in alignment with the axis 13 of the shaft 12 of the respective flanging tool 27. Such an arrangement is disclosed for an apparatus for flanging and necking a can body, for example, in U.S. Pat. No. 4,070,888, FIG. 1 where the counter tool (counter supporting component) is designated at 250.

As shown in FIGS. 1 and 2, for flanging both, opposite edges of a can body, the flanging machine has flanging tools 27', which, in cooperation with a respective flanging tool 27, positions and holds a respective can body C. Thus, as viewed in the Figures, the flanging tools 27 mounted on to the turret 4 form flanges on the lower can edges, while the flanging tools 27' mounted on the turret 4' form flanges on the upper can edges. Therefore, in each tool pair composed of cooperating flanging tools 27 and 27', the two flanging tools mutually function as a counter tool of the other. The turret 4' rotates in unison and in axial alignment with the turret 4. In each pair of cooperating flanging tools 27 and 27' the axis 13 is in alignment with the axis 13' of the spindle 7' and the shaft 12'. The spindle 7' may be either axially stationary or—as the spindle 7—may be axially reciprocated by a control cam similar to the control cam 9 of the turret 4 to ensure that the flanging tools 27, 27' may enter into the can body simultaneously on both sides for performing the flanging operation.

The shafts 12, 12' are so positioned that the coaxially disposed axes 13 and 13' and the axes 19 and 19' of the obliquely disposed shaft stubs 17 and, respectively 17' lie in a single plane so that the contacting points of the flanging faces 23, 23' are in each instance opposite one another.

The base form of the inner flanging tools 20, 20' and the inner faces 15, 15' of the flanging sleeves 14, 14' may also be of non-circular configuration as viewed in a top plan view.

It will be understood that the above description of the present invention is susceptible to various modifications, changes and adaptations, and the same are intended to be comprehended within the meaning and range of equivalents of the appended claims.

What is claimed is:

1. An apparatus for flanging an edge of a can body, comprising (a) a flanging tool including (1) an inner tool part having an outer circumferential flanging face adapted to engage an inner surface of a circumferential edge zone of the can body;

(2) an outer tool part surrounding said inner tool part and having an inner circumferential abutment face surrounding the flanging face for abutting a periphery of the can body edge during flanging of the can body edge by said flanging face;

(3) an axially hollow spindle having a first axis; said outer tool part being affixed to the spindle;

(4) first securing means for preventing rotation of said spindle about said first axis;

(5) a shaft received in said spindle and having a second axis coinciding with said first axis; said shaft being supported for rotation about said second axis;

(6) a shaft stub affixed to and extending from said shaft; said inner tool part being rotatably mounted on said shaft stub; said shaft stub having a central, third axis disposed at an inclination to said second axis; said second and third axes intersecting in a point of intersection situated substantially at an axial position corresponding to an axial position of said flanging face of said inner tool part; and (7) second securing means for preventing a rotation of said inner tool part and said outer tool part relative to one another;

(b) first drive means for rotating said shaft about said second axis;

(c) a counter tool being axially aligned with said second axis and being spaced from said flanging tool; said flanging tool and said counter tool jointly holding a can body at opposite ends thereof; and (d) second drive means for axially urging said flanging tool and said counter tool toward one another for effecting flanging of the can body at said flanging face of said inner tool part.

2. The apparatus as defined in claim 1, wherein said flanging tool is a first flanging tool and said counter tool is a second flanging tool structured substantially identically to said first flanging tool; said second flanging tool including (a) an inner tool part having an outer circumferential flanging face adapted to engage an inner surface of a circumferential edge zone of the can body;

(b) an outer tool part surrounding said inner tool part and having an inner circumferential abutment face surrounding the flanging face for abutting a periphery of the can body edge during flanging of the can body edge by said flanging face;

(c) an axially hollow spindle having a first axis; said outer tool part being affixed to the spindle;

(d) first securing means for preventing rotation of said spindle about said first axis;

(e) a shaft received in said spindle and having a second axis coinciding with said first axis; said shaft being supported for rotation about said second axis;

(f) a shaft stub affixed to and extending from said shaft; said inner tool part being rotatably mounted on said shaft stub; said shaft stub having a central, third axis disposed at an inclination to said second axis; said second and third axes intersecting in a point situated substantially at an axial position corresponding to an axial position of said flanging face of said inner tool part; said second axis of said shaft of said first flanging tool and said second axis of said shaft of said second flanging tool being in alignment with one another; said second axis of said shaft of said first flanging tool, said second axis of said shaft of said second flanging tool, said third axis of said shaft stub of said first flanging tool and said third axis of said shaft stub of said second flanging tool lying in a single plane; and (g) second securing means for preventing a rotation of said inner tool part and said outer tool part relative to one another.

3. The apparatus as defined in claim 1, wherein said second securing means comprises (a) an axially extending longitudinal groove provided in a circumferential surface of said inner tool part; and (b) a radially extending pin held in said outer tool part and extending into said longitudinal groove.

4. The apparatus as defined in claim 1, wherein said inner tool part includes a circumferential face surrounded by said abutment face of said outer tool part; said circumferential face of said inner tool part conically tapering away from said flanging face.

5. The apparatus as defined in claim 1, wherein said inner tool part includes a circumferential face surrounded by said abutment face of said outer tool part; said circumferential face of said inner tool part having a spherical surface; said spherical surface having a sphere center coinciding with said point of intersection.

* * * * *